US005346148A

United States Patent [19]

Hand et al.

[11] Patent Number: 5,346,148

[45] Date of Patent: Sep. 13, 1994

[54] ASYMMETRIC PULVERIZER TIRE

[75] Inventors: Bryan Hand, Norton; Ronald D. Mizak, Wadsworth; Robert R. Piepho, Akron, all of Ohio

[73] Assignee: The Babcock & Wilcox Company, New Orleans, La.

[21] Appl. No.: 33,694

[22] Filed: Mar. 16, 1993

[51] Int. Cl.[5] ..... B02C 15/06; B02C 15/14

[52] U.S. Cl. ..... 241/293; 241/117; 164/108

[58] Field of Search ..... 241/DIG. 30, 102, 117, 241/120, 121, 293, 300; 492/3, 30, 37, 49, 53, 54; 164/108; 228/119; 219/76.1

[56] References Cited

U.S. PATENT DOCUMENTS

| | | | |
|---|---|---|---|
| Re. 25,552 | 4/1964 | Berz | 241/118 |
| 936,079 | 10/1909 | Best | 241/118 |
| 2,944,744 | 7/1960 | Berz | 241/132 |
| 3,014,266 | 12/1961 | Samuels et al. | 492/53 |
| 3,169,712 | 2/1965 | Schauer et al. | 241/117 |
| 3,194,506 | 7/1965 | Bourne et al. | 241/300 |
| 3,606,179 | 9/1971 | Ramanowski et al. | 241/103 |
| 3,612,417 | 10/1971 | Barton | 241/103 |
| 3,612,418 | 10/1971 | Barton | 241/118 |
| 3,730,446 | 5/1973 | Piepho | 241/110 |
| 3,804,346 | 4/1974 | Norman | 241/300 |
| 4,433,032 | 2/1984 | Nakamura et al. | 492/3 |
| 4,717,082 | 1/1988 | Guido et al. | 241/121 |
| 5,044,056 | 9/1991 | Sundsted et al. | 492/3 |
| 5,050,810 | 9/1991 | Parham | 241/117 |
| 5,154,074 | 10/1992 | Haraguchi et al. | 492/3 |

*Primary Examiner*—Timothy V. Eley
*Attorney, Agent, or Firm*—Robert J. Edwards; Eric Marich

[57] ABSTRACT

Reinforcement sections are provided at an outer surface and at an inner surface of a tire for a roll wheel assembly used in a pulverizer for crushing a material such as coal. These reinforcing sections cause the tire to be asymmetrical and are located on the tire only at areas where the wearing of the tire is highly predictable. The reinforcing sections provided on the inner surfaces of the tire are provided directly opposite of the reinforcing sections on the outer surface for preventing the localized thinning of the tire and extending the time interval between rotation and/or replacement of the tires.

14 Claims, 3 Drawing Sheets

ASYMMETRIC PULVERIZER TIRE

FIELD AND BACKGROUND OF THE INVENTION

The present invention relates in general to grinding elements for pulverizers and in particular to a new and useful design for a tire used in a roll wheel assembly for a pulverizer which increases the wear life of the tire.

Pulverizers are commonly used to grind various materials in the coal processing, ceramic, and chemical industries. A roll and race pulverizer uses grinding elements comprising a plurality of roll wheel assemblies or tires suspended from driving arms and which rotate around their respective axes of rotation through contact against a grinding ring or race for grinding and reducing the size of the incoming material, particularly coal. Each grinding element or roll wheel assembly uses a replaceable outer tire. Currently, the replaceable outer tires used in the roll wheel assemblies are manufactured from alloy as a casting and are symmetrical about a radial center plane.

Despite the symmetrical orientation of the replaceable outer tires of the roll wheel assemblies, the tires wear unevenly during normal pulverizer operation. The problem with uneven wear can be resolved by rotation; i.e., a side-to side reversal of the partly worn tire comprising each roll wheel assembly. However, to perform this operation the pulverizer has to be stopped and taken out of service for a significant period of time. The task of pulverizer tire rotation requires removal of the entire roll wheel assembly from the pulverizer through an access door. This is a difficult and labor intensive operation; special equipment is required because each roll assembly can weigh as much as 35,000 pounds. Once removed from the pulverizer, the tires must be disassembled from the roll wheel assemblies by performing a heating operation. This raises the possibility of local overheating and resultant cracking, which will ruin the tire and require it to be repaired, if possible, or replaced. Additionally, only a slight improvement in useful tire life is achieved through this tire rotation procedure, and it is generally not enough to justify the costs involved.

Thus a need exists for an improved pulverizer tire for a roll wheel assembly that can provide increased wear life at minimal additional cost.

SUMMARY OF THE INVENTION

The present invention comprises a replaceable outer tire for a roll wheel assembly having a reinforcing section at the outer surface of the tire for contacting and crushing the material. A second reinforcing section is provided on an inner surface of the tire directly opposite of the reinforcing section on the outer surface of the tire for minimizing wearing of the tire.

The reinforcing sections can be made of a reinforcing material which is located at the outer surface and the inner surface of the tire where the tire is most likely subjected to normal wear. The reinforcing sections minimize localized thin spots which can occur during normal wear of the tire.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

DESCRIPTION OF THE PREFERRED EMBODIMENTS

Figure 1:
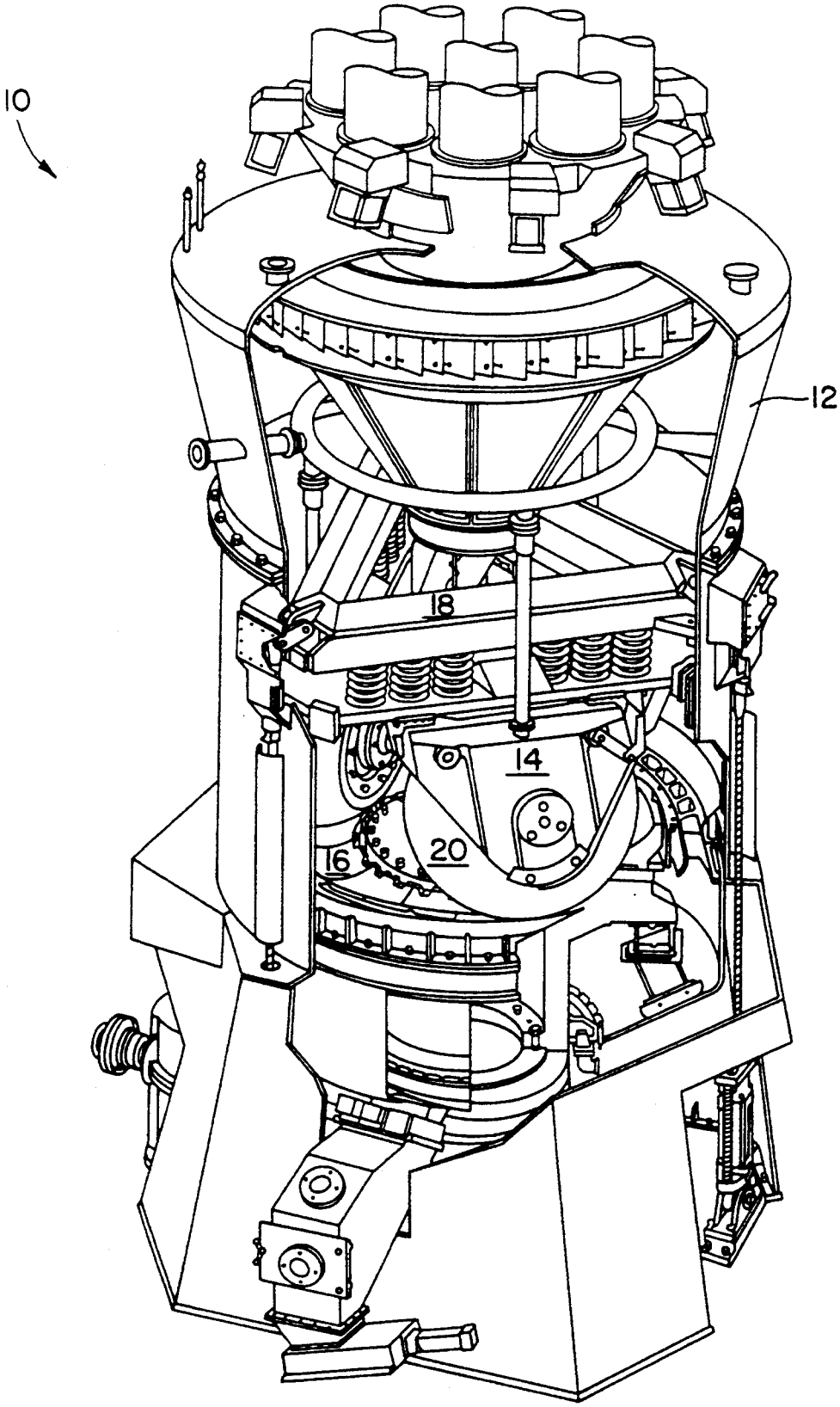
FIG. 1 is a perspective view of a pulverizer.

Referring to the Figures generally, wherein like numerals designate the same element throughout the several drawings, FIG. 1 shows a perspective view of a pulverizer generally designated 10, for grinding incoming material such as coal. The grinding or crushing of coal in the pulverizer 10 is conducted within a pulverizer housing 12. The pulverizer housing 12 contains a plurality of roll wheel assemblies 14, typically three in number, which are pressed against a grinding ring 16 by a spring loading system 18. The grinding ring 16 rotates about a vertical axis of the pulverizer 10, and each of the plurality of roll wheel assemblies 14 has a replaceable outer grinding element or tire 20 mounted for rotation thereon. Each tire 20 rotates around its respective axis of rotation through contact against the grinding ring 16, the incoming material being crushed therebetween.

Figure 2:
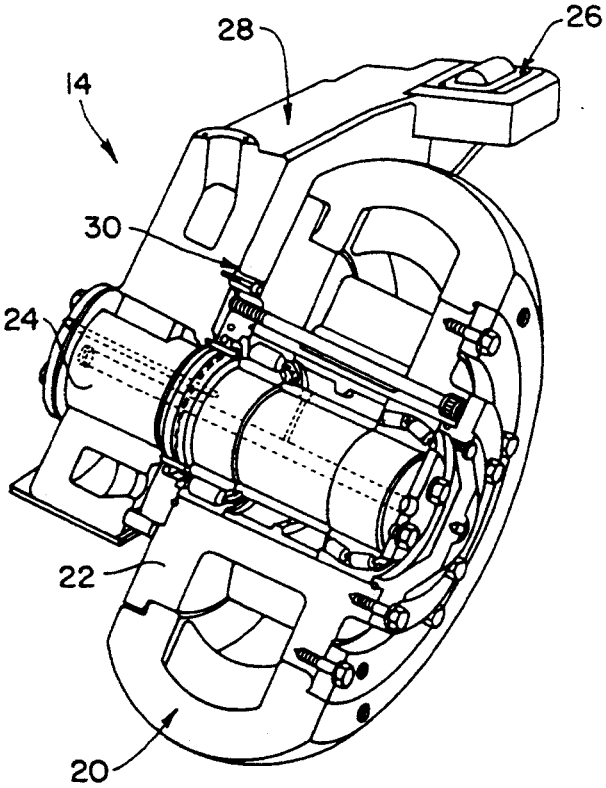
FIG. 2 PRIOR ART
FIG. 2 is a cross-sectional view of a roll wheel assembly of the pulverizer of FIG. 1.

Referring to FIG. 2, each roll wheel assembly 14 comprises the replaceable outer grinding element or tire 20 supported on a tire support 22 rotatably mounted about an axle 24 of the roll wheel assembly 14. Each roll wheel assembly 14 uses a roll pin block 26 and a roller bracket 28 to allow the tire 20 to rotate about its axis as the grinding ring 16 rotates within the pulverizer 10. A roll air seal 30 is provided for sealing coal and other abrasive particles out of the roll wheel assembly 14.

Figure 3A:
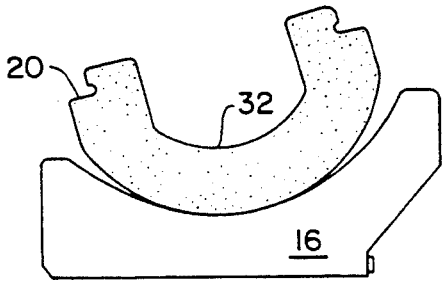
FIG. 3A PRIOR ART
FIG. 3 is a schematic representation of the grinding element profiles of a tire for the roll wheel assembly of FIG. 2 showing how they wear from initial profile to end of useful life.
Figure 3B:
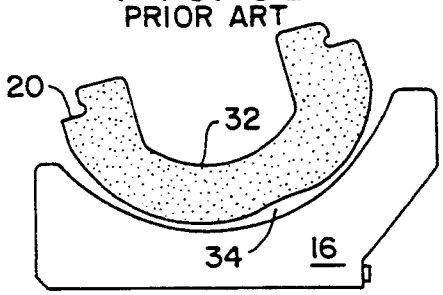
FIG. 3B PRIOR ART
Figure 3C:
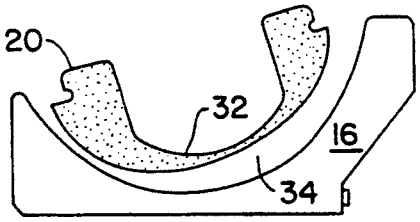
FIG. 3C PRIOR ART

FIG. 3 illustrates the design of tires 20 commonly used in pulverizers 10. It will be observed that the tires 20 commonly used in these pulverizers 10 have an inner section 32 and a wear zone 34 which contacts the material lying within the grinding ring 16. The tires are commonly made of a highly abrasion resistant material such as one of the white irons specified in ASTM A 532. During normal use, the tire 20 is reduced in size because of the abrasive properties of the material being ground, the tire 20 wearing at the wear zone 34 which results in a thinning of the tire 20.

Figure 4:
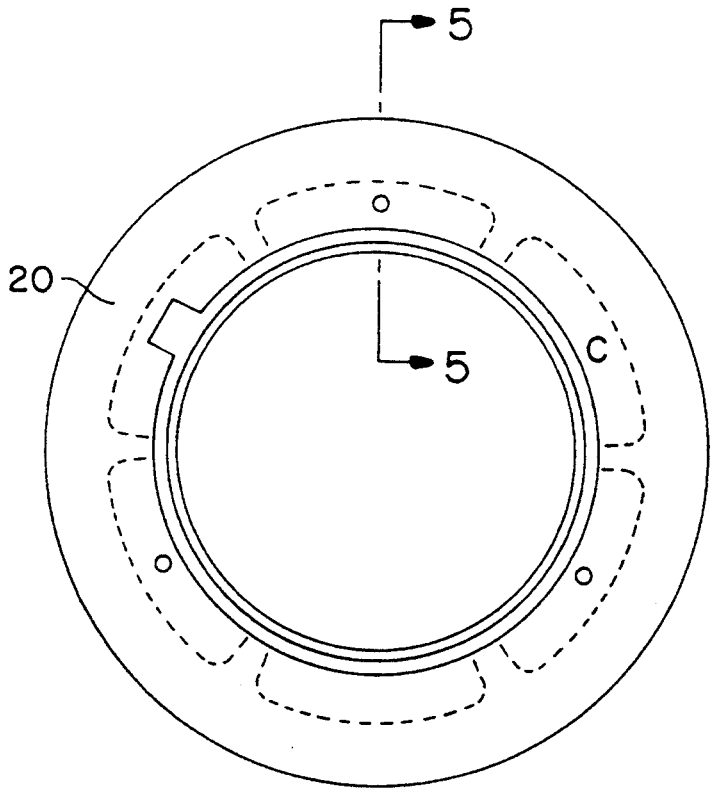
FIG. 4 is an elevational side view of a tire according the present invention.
Figure 5:
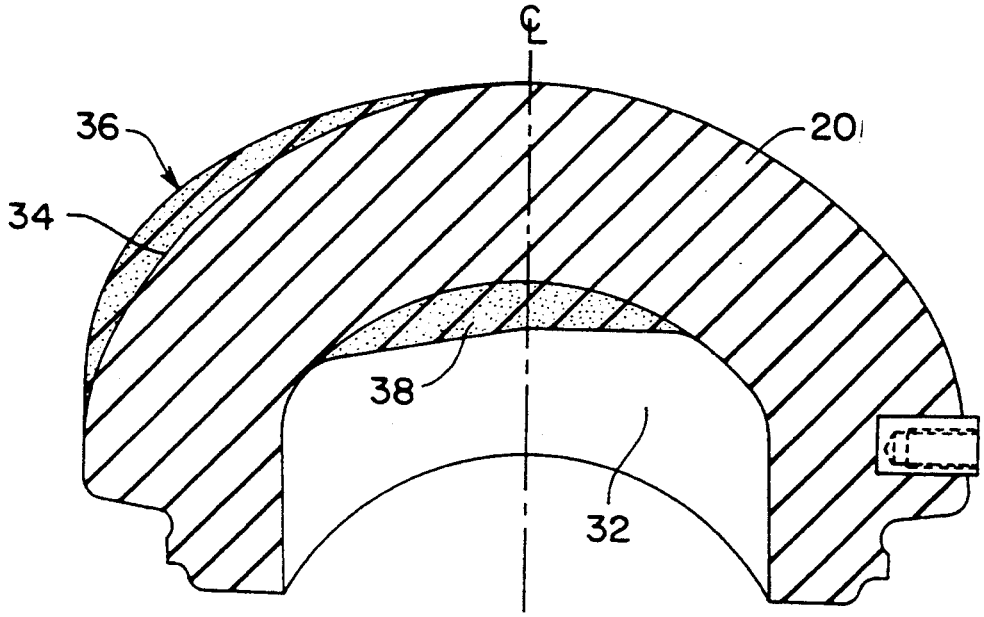
FIG. 5 is a cross-sectional view taken along line 5—5 of the tire of FIG. 4.

Referring now to FIGS. 4–5, there is shown the present invention. As shown therein, the present invention comprises the tire 20 having a reinforcement section 36 located at the wear zone 34. A reinforcement section 38 is also provided at the inner section 32 of the tire 20 directly opposite the wear zone 34 for preventing localized thinning of the tire 20 as it wears during pulverizer operation. The reinforcement sections 36 and 38 are preferably made of the same material or alloy as that of the balance of the tire 20, or it can be made of a different wear resistant material to further enhance the wear life of the tire 20. The reinforcing sections 36 and 38 may be affixed to an existing tire 20 by means of weld deposition methods, or it can be part of the tire in an as-cast configuration. Composite casting methods i.e., wherein preformed reinforcement sections are placed in the casting mold prior to pouring the molten metal forming the balance of the tire, can also be employed to produce a tire 20 with the reinforcing sections 36 and 38. Alternatively, the reinforcing sections 36 and 38 could be made as separate elements which are then later mechanically affixed via fasteners or the like to an existing tire 20. Finally, yet another approach to creating a tire 20 with the reinforcing sections 36 and 38 is add them by sleeving them over and into an existing tire 20.

The present invention thus provides for a tire 20 having an asymmetrical outside diameter surface which results in improved wear life with only a minor increase in maximum section thickness. An immediate benefit is that the time interval between pulverizer tire 20 rotation and/or replacement is increased.

In lieu of the aforementioned asymmetrical outside diameter surface, a larger symmetrical outside diameter surface could be added. However, this would be a costly and inefficient use of costly alloy material. In lieu of an inside surface that approximates the outside wear configuration, a tire 20 could be designed with a symmetrical inside surface having an equivalent minimum thickness or with a solid alloy core. However, once again this would not be an efficient use of this costly alloy material. In addition, a massive increase in section thickness greatly increases the difficulty of achieving reliably sound castings and attendant increases in reject rates for these castings and associated costs.

Reinforcement sections 36 and 38 are provided on the tire 20 only at predictable high wear areas, resulting in an approximately 30% increase in tire 20 wear material thickness, with only an approximately 10% increase in overall tire 20 weight.

While specific embodiments of the invention have been shown and described in detail to illustrate the application of the principles of the invention, it will be understood that the invention may be embodied otherwise without departing from such principles.

We claim:

1. A tire for a roll wheel assembly used to crush material in a pulverizer, the tire having an asymmetrical outside diameter outer surface for contacting and crushing the material, the tire comprising:

a first reinforcing section fixed to the outer surface of the tire to provide the asymmetrical outside diameter outer surface at a location where the tire is subjected to wearing due to performing the crushing of the material; and a second reinforcing section fixed to an inner surface of the tire directly opposite of the location where the tire is subjected to wearing for minimizing localized thinning of the tire.

2. The tire according to claim 1, wherein the reinforcing sections are at areas where the tire wearing is predictable.

3. The tire according to claim 1, wherein the tire is made of an alloy.

4. The tire according to claim 3, wherein the reinforcing sections are made of the same alloy as the tire.

5. The tire according to claim 1, wherein the reinforcing sections are made of a different material than that of the tire.

6. A method for prolonging the use of a tire of a roll wheel assembly for a pulverizer used for contacting and crushing a material, the method comprising:

providing a reinforcing section on an outer surface of the tire to provide an asymmetrical outside diameter outer surface on the tire at a location where the tire is subjected to wearing due to performing the crushing of the material; and providing a reinforcing section on an inner surface of the tire directly opposite of the location where the tire is subjected to wearing for minimizing localized thinning of the tire.

7. The method according to claim 6, wherein the reinforcing section is created by adding at areas on the tire where the tire wearing is predictable.

8. The method according to claim 6, wherein the thickness of the tire is increased 30% after providing the reinforcing material on the tire.

9. The method according to claim 8, wherein the weight of the tire is increased not more than 10% after providing the reinforcing material on the tire.

10. The method according to claim 6, wherein the reinforcing sections are created by affixing additional material by means of weld deposition to an existing tire.

11. The method according to claim 6, wherein the reinforcing sections are created by casting them as part of the tire in an as-cast configuration.

12. The method according to claim 6, wherein the reinforcing sections are created by composite casting methods comprising the steps of placing preformed reinforcement sections in a casting mold prior to providing molten metal forming the balance of the tire to cast the sections into the tire.

13. The method of claim 6, wherein the reinforcing sections are made as separate elements which are later mechanically affixed via fasteners to an existing tire.

14. The method of claim 6, wherein the reinforcing sections are created by sleeving them over and into an existing tire.

* * * * *